US005124755A

United States Patent [19]

Hediger

[11] Patent Number: 5,124,755

[45] Date of Patent: Jun. 23, 1992

[54] MECHANICAL WIDE NIP FLEXIBLE FUSER USING MULTIPLE LOOPED MATERIAL BELTS

[75] Inventor: Edwin A. Hediger, Fairport, N.Y.

[73] Assignee: Eastman Kodak Company, Rochester, N.Y.

[21] Appl. No.: 718,479

[22] Filed: Jun. 21, 1991

[51] Int. Cl.[5] ..... G03G 15/20

[52] U.S. Cl. ..... 355/285; 219/216; 355/290; 432/59

[58] Field of Search ..... 355/282, 285, 290, 289, 355/291, 295; 219/216, 469; 432/59

[56] References Cited

U.S. PATENT DOCUMENTS

| | | | |
|---|---|---|---|
| 3,502,407 | 3/1970 | Granzow et al. | 355/285 |
| 3,810,735 | 5/1974 | Moser | 219/216 X |
| 4,242,566 | 12/1980 | Scribner | 219/216 |
| 4,563,073 | 1/1986 | Reynolds | 355/284 |
| 4,745,432 | 5/1988 | Langdon | 355/290 |
| 4,814,819 | 3/1989 | Torino et al. | 219/469 |
| 4,905,049 | 2/1990 | Bickerstaff et al. | 355/284 |

FOREIGN PATENT DOCUMENTS

| | | |
|---|---|---|
| 61-90180 | 5/1986 | Japan . |
| 61-93476 | 5/1986 | Japan . |
| 62-14676 | 1/1987 | Japan . |

*Primary Examiner*—A. T. Grimley
*Assistant Examiner*—William J. Royer
*Attorney, Agent, or Firm*—J. Gary Mohr

[57] ABSTRACT

An improved fixing assembly for fixing toners or the like on a receiving medium. The improved fixing assembly having a mechanical wide nip formed by a pair of nip forming belts with at least one of the belts being formed by multiple overlapping loops of cold rolled stainless steel. The ends of the stainless steel are secured to the loop adjacent to each end of the stainless steel. The stainless steel flexible formed belt may be coated and heated. Each belt is driven by a pair of internal friction drive rollers with the drive rollers being driven by a toothed belt engaging the drive rollers. The width of the nip is adjusted by changing the center distance between the friction drive rollers of the flexible belts.

12 Claims, 3 Drawing Sheets

Fig. 1
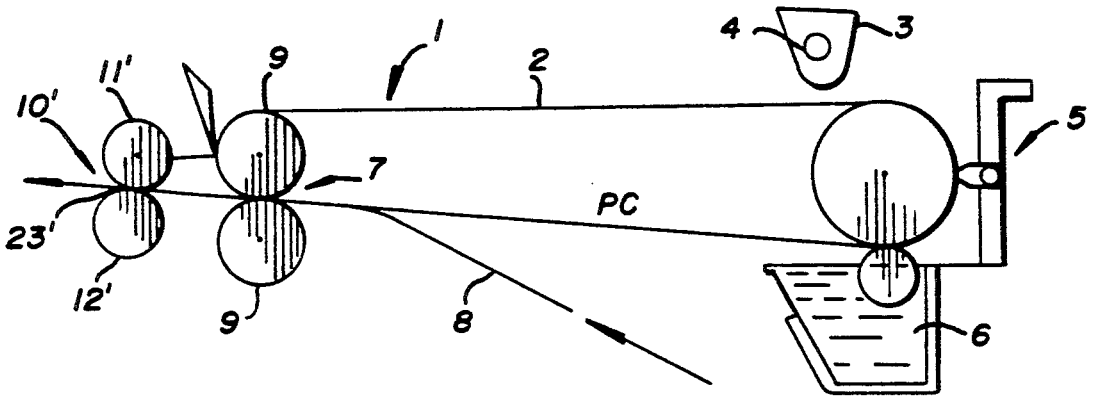
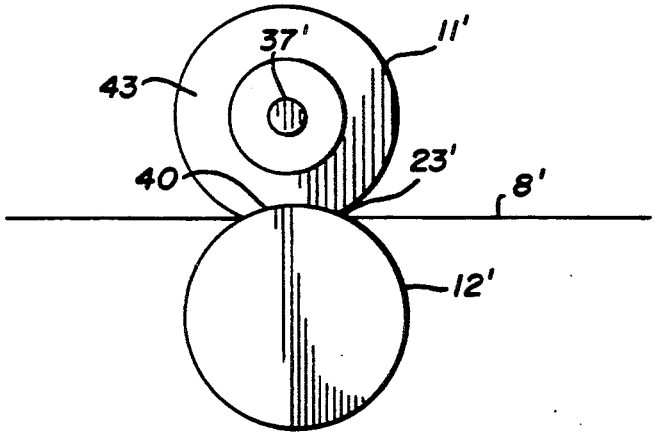
Fig. 4

MECHANICAL WIDE NIP FLEXIBLE FUSER USING MULTIPLE LOOPED MATERIAL BELTS

BACKGROUND OF THE INVENTION

This invention relates generally to an apparatus for fixing toners or the like on a receiving medium. The fixing is accomplished by pressure and/or heat being applied to the receiving medium as it and a toned image contained thereon pass through a nip formed by a pair of belts.

As in any apparatus for fixing toners, the feeding and contact parameters, as the receiving medium passes through the nip, are critical. Without the proper feeding and contact parameters the following problems may result:

1. Defects in the fixed image caused by localized stresses, velocity changes and static charge in the nip mechanics during the fixing process. This results from roller non-compliancy and the receiving medium traveling in multiple planes as it approaches, travels through and leaves the nip. Additionally, since solid or hard rollers, normally used in the fixing process, do not have the capacity to adapt between the thicker areas on the receiving medium, i.e., those containing the copy image, and the thinner areas, i.e., those not containing copy image; localized stress is further increased.

2. Internally heated rollers with inefficient thermal conductivity because their heat lamps are normally located within poor heat conductors such as thick elastomer or foam material rollers.

3. Distortions in the fixed image, paper grab, paper curl, loss of paper stiffness and excessive roller wear resulting from the increase in torque required for one roller to break the plane of the other roller when the nip width is increased by increasing the pressure in the nip.

In the past, to avoid feeding and contact problems, such as stated above, and to prevent movement of toner particles and localized stress that causes image defects and distortion, one tried to increase the compliancy of one or more of the rollers in the fixing assembly, the width of the nip or the flatness of the fixing nip to lessen the effects of such process-related defects and distortions. Attempts made to increase the compliancy, flatness or width of the nip and thereby lessen the fixing related defects included making the elastomeric layers of the rollers thicker and using elastomeric foam materials such as disclosed in U.S. Pat. No. 4,814,819. However, since fixing rollers are usually heated internally, it was difficult to obtain an elastomeric material that was sufficiently compliant while having a heat conductivity that efficiently provided the heat necessary to fix the toned images. Additional solutions, such as disclosed in Japanese Patent No. 61-90180, included forming a heated roller and a pressure roller of elastically deformable thin cylinders with a plurality of guide members arranged on the inside or outside of the cylinders. In that type of arrangement, however, it was difficult to maintain a uniform nip pressure, since the cylinders did not uniformly deform when a receiving medium entered the nip formed by such cylinders as shown in U.S. Pat. No. 4,563,073. Therefore, the above attempted solutions proved unsatisfactory.

SUMMARY OF THE INVENTION

The present invention, while general to the field of toner fixing, more particularly relates to an improved fixing assembly for fixing an image on a receiving medium as the receiving medium travels through the fixing assmebly. The fixing assembly of the present invention has a wide compliant nip in the direction of the path of travel of the receiving medium. The nip is formed by a pair of nip forming belts, at least one of which is constructed of multiple overlapping loops of a belt forming material continuously looped upon itself until the desired shell thickness and flexibility of the belt is obtained. Once the desired shell thickness is obtained, each end of the belt forming material is secured to the loop adjacent each end of said belt forming material. The formed flexible belt may be coated and heated.

It is, therefore, an object of the present invention to solve the problems of the prior art by providing a fixing assembly having a wide compliant adjustable nip with:

1. Minimal defects in the fixed image caused by localized stresses, velocity changes and static charge in the nip mechanics.

2. Internally heated rollers having efficient thermal conductivity that require minimal time to reach operational temperature.

3. The ability to change nip width without changing the fixing pressure and thereby reducing image distortions.

4. Elimination of paper grab, curl and loss of stiffness.

5. Reduction of roller wear.

FIG. 1 is a schematic end view of a photocopying apparatus with a typical prior art toner fixing assembly.

FIG. 4 is a schematic side view of the typical prior art fixing and pressure rollers and the nip formed by such rollers.

DESCRIPTION OF THE PREFERRED EMBODIMENT OF THE INVENTION

Figure 2:
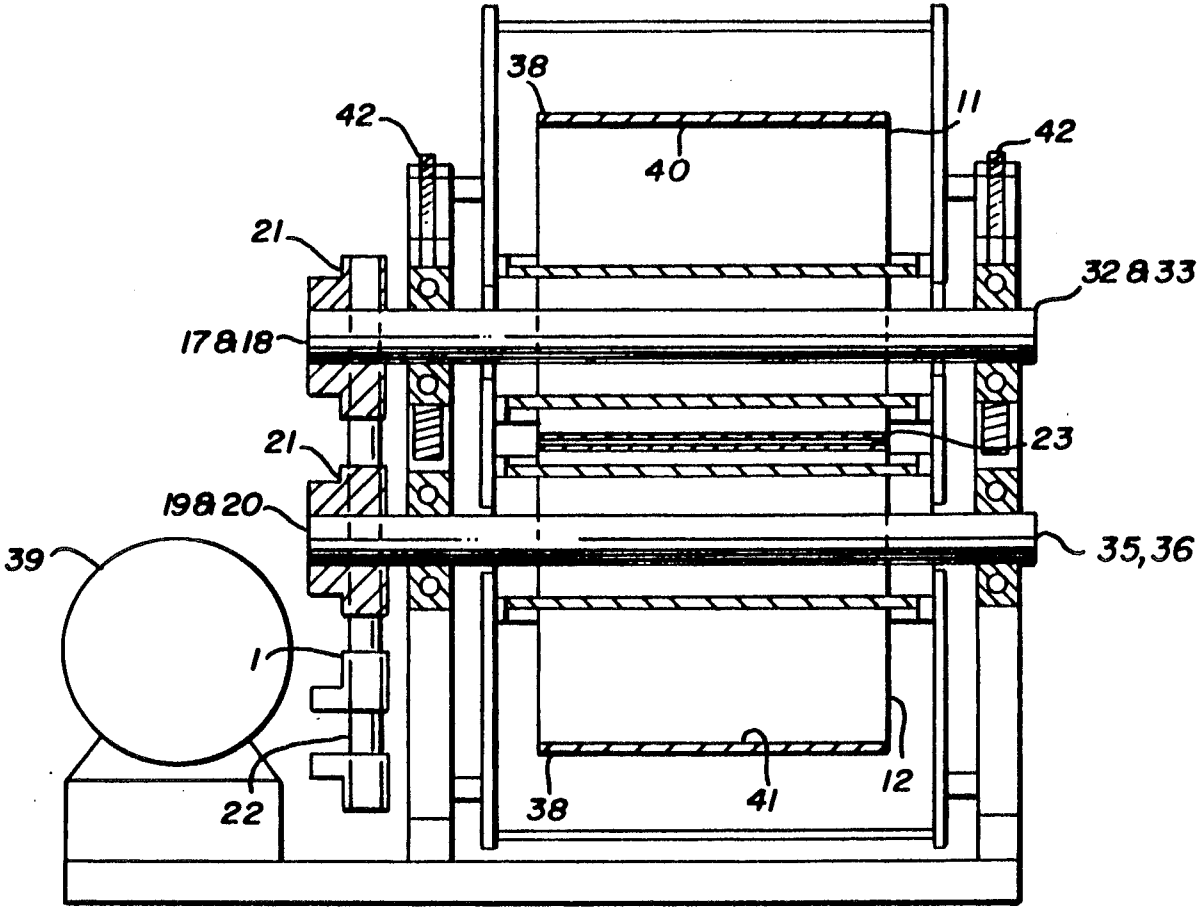
FIG. 2 is a front view of both the fixing belt and the pressure belt according to the present invention.

In describing the preferred embodiment which, by way of example but not by way of limitation, is illustrated in relation to a photocopying apparatus, reference is made to the drawings, wherein like numerals indicate like parts and structural features in the various views, diagrams and drawings. FIG. 1 schematically shows the typical stations of a photocopying apparatus, wherein a photoconductive belt 1 containing a photosensitive image surface 2 is sensitized by charger 3 comprised of a corona-generating device 4. The photosensitive image surface 2 is sensitized prior to image exposure at exposure station 5. The exposed photosensitive image surface 2 of photoconductive belt 1 is then passed through a development station 6 for toning. After the development station, the toned image is transferred at transfer station 7, consisting of transfer rollers 9, from the photoconductive belt 1 to a receiving medium 8. Once transfer is accomplished, receiving medium 8, bearing the toned image, is stripped from the photoconductive belt 1, and receiving medium 8 and its toned image are thereafter conveyed to a fixing station 10'. Fixing station 10', as shown in FIG. 4, is comprised of a fixing roller 11' and a pressure roller 12'. The image is fixed on the receiving medium 8 at fixing station 10' by the pressure and heat contained in the nip 23' between rollers 11' and 12' of fixing station 10'. The receiving medium 8 is then discharged into a catch tray, not shown, for collection by an operator.

Figure 3:
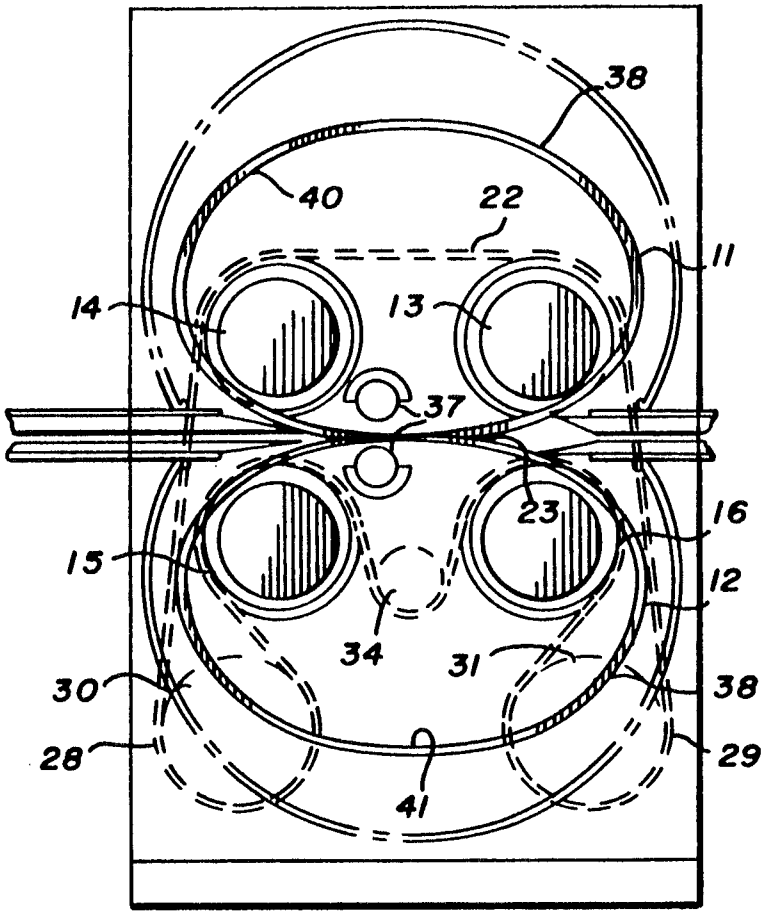
FIG. 3 is a schematic end view of the fixing and pressure belts and the nip formed by such belts according to the present invention.

Referring to FIG. 3, a preferred embodiment of the present invention, the fixing assembly 10 is improved by having at least the fixing belt 11 or the pressure belt 12 constructed of multiple overlapping loops of cold rolled stainless steel, or other belt forming material with a preferred thickness for the cold rolled stainless steel of 0.005 inches, however, a thickness in the 0.003 to 0.007 inch range is within acceptable limits. The cold rolled stainless steel is continuously looped upon itself until a preferred thickness of 0.13 inches is obtained, however, a thickness in the 0.100 to 0.200 inch range is within acceptable limits. After the looping is completed, each end of the stainless steel material is secured to the loop adjacent each end of the stainless steel material to form a flexible stainless steel belt. The flexible stainless steel belt 11 and/or 12, once formed, may be coated with a thin layer of silicone rubber, or similar material, 38 having a preferred thickness for the silicon layer of 0.025 inches, however, a thickness in the 0.010 to 0.040 inch range is within acceptable limits. This coating helps to prevent toner from sticking to belts 11 and 12, provides additional compliance for toner pile height variations and compensates for the step where the end of the stainless steel forming material is joined to the adjacent loop on the outer diameter of belt 11 and/or 12.

Located internally of belt 11 are drive rollers 13 and 14, and internally of belt 12 are drive rollers 15 and 16, as shown in FIG. 3. Externally of belts 11 and 12 are idler rollers 28 and 29. Driver roller 13, 14, 15 and 16 and idler rollers 28 and 29 have secured at their ends 17, 18, 19, 20, 30 and 31, respectively, identical tooth gears 21, see FIG. 2, upon which toothed drive belt or chain 22 rides. Also located internally of belt 12 is idler gear 34 upon which drive belt 22 also rides. Drive belt 22 is driven by a motor 39, see FIG. 2, which causes drive belt 22, through identical tooth gears 21, to drive rollers 13, 14, 15 and 16 at the same rate of rotation.

As further shown in FIG. 3, rollers 13 and 14 are in frictional contact with the internal surface 40 of belt 11, and rollers 15 and 16 are in frictional contact with the internal surface 41 of belt 12. The rate of rotation of belt 11 is the same as the rate of rotation of belt 12. By maintaining the same rate of rotation, receiving medium 8 is not subjected to wrinkling or tearing while in nip 23 formed by belts 11 and 12. The width of nip 23 may be lengthened or shortened by changing the center distance between drive rollers 13 and 16 and the center distance between drive rollers 14 and 15.

Adjustment screws 42 adjust and retain the position of shafts 32 and 33 in relation to shafts 35 and 36. Additional adjusting screws, identical in function to adjusting screws 42, could be added to adjust the position of shafts 35 and 36 in relation to shafts 32 and 33. Since the location of shafts 32 and 33, which rotate with friction rollers 13 and 14, are defined by the movement of adjustment screws 42, and the location of shafts 35 and 36, which rotate with friction rollers 15 and 16, could be defined by the movement of adjustment screws such as 42, the drive and shape of belts 11 and/or 12, as well as the width of nip 23, is determined by the movement of adjustment screws 42. Therefore, the width of nip 23, formed by belts 11 and 12, increases as the center distance of roller 13 with respect to roller 16 and the center distance of roller 14 with respect to roller 15 decrease without the loss of compliancy of belts 11 or 12.

In operation the fixing assembly 10 of the present invention has a wide flat nip 23, since at least one of the belts 11 or 12 forming nip 23 is flexible. Because of this arrangement, the width of nip 23 is capable of being adjusted through movement of drive rollers 13 and 14 without changing the pressure in nip 23 or the compliancy of belts 11 or 12. If, however, drive rollers 15 and 16 are also adjustable by the addition of additional adjustment screws, such as adjusting screws 42, the width of nip 23 would also be adjustable by movement of drive rollers 15 and 16 without increasing the pressure in nip 23 or changing the compliancy of belts 11 or 12. This allows receiving medium 8, as it approaches, to pass through and leave nip 23 to maintain itself in a single plane of travel with minimal localized stress. Additionally, since flexible belts 11 and 12, as opposed to solid or hard rollers, have the capacity to adapt between the thicker areas on the receiving medium 8, i.e., those containing the copy image, and the thinner areas, i.e., those not containing any copy image, flexible belts 11 and 12 are more compliant and local stress is further minimized.

In one embodiment of the present invention, the transfer of heat from internal heat lamp 37 is maximized, since the combination of a heat lamp 37, in close proximity to stainless steel belts 11 and 12, has strong heat transferring capabilities. This capacity to transfer a maximum amount of heat allows the fixing assembly 10 to quickly reach operating temperature.

Still further, in the present invention, there is minimal velocity change within nip 23. This minimizes the stress placed upon receiving medium 8, since receiving medium 8 continues to maintain its travel in a single plane, prior to, while in and subsequent to nip 23. Single plane travel also reduces static charge, paper curl, loss of paper stiffness and river and lake effects, since the rubbing caused by multiplane travel is eliminated in single plane travel.

In the described embodiment of the present invention, the torque required to drive belts 11 and 12 is significantly reduced, since belt 12 doesn't have to overcome the force necessary to break the plane of belt 11, because there is no need to increase pressure in nip 23 to increase the width of nip 23.

While the present invention has been described with reference to the particular structure disclosed herein, it is not intended that it be limited to the specific details, and this application is intended to cover such modifications or changes as may come within the purposes of the improvements or scope of the claims forming a part hereof.

What is claimed:

1. An improved fixing assembly comprised of means for fixing an image onto a medium as the medium travels in a path through the fixing assembly, the fixing assembly having a wide nip along the path of travel of the medium with the wide nip formed by a pair of nip forming belts with at least one of said belts being a multiple looped material.

2. The improved fixing assembly of claim 1 wherein the multiple looped material is a cold rolled metal.

3. The improved fixing assembly of claim 2 wherein the belt formed by the cold rolled metal is driven by a pair of friction rollers, and the pair of friction rollers is located internally of the belt formed by the cold rolled metal.

4. The improved fixing assembly of claim 1 wherein both nip forming belts are flexible and of a multiple looped material.

5. The improved fixing assembly of claim 4 wherein each of the flexible belts is driven by a pair of friction rollers located internally of each flexible belt.

6. The improved fixing assembly of claim 5 wherein the friction rollers are all driven by a common toothed belt.

7. The improved fixing assembly of claim 6 wherein an identical tooth gear is located on each friction roller with means to maintain a constant rotational speed between all friction rollers driven by the common toothed belt.

8. The improved fixing assembly of claim 5 wherein at least one of the friction rollers has an adjustment means to adjust its spacing relative to the other friction roller.

9. The improved fixing assembly of claim 4 wherein at least one of the flexible belts has a heating means located adjacent it.

10. The improved fixing assembly of claim 5 wherein the friction rollers are all driven by a common chain.

11. An improved fixing assembly comprised of means for fixing an image onto a medium as the medium travels in a path through the fixing assembly, the fixing assembly having a mechanical long fixing nip formed by a pair of flexible looped cold rolled stainless steel belts with both flexible stainless steel belts driven by a pair of friction rollers located internally of the flexible stainless steel belts and the friction rollers driven by a common tooth belt which drives an identical tooth gear located on each friction roller, at least one of the friction rollers having an adjustment means to adjust said friction roller's position in relation to the other friction roller.

12. The improved fixing assembly of claim 11 wherein the cold rolled stainless steel has a thickness of 0.005 inches continuously loop to a shell thickness of 0.13 inches and coated with a silicone rubber having a thickness of 0.025 inches.

* * * * *